US009782800B2

(12) United States Patent
Renz et al.

(10) Patent No.: US 9,782,800 B2
(45) Date of Patent: Oct. 10, 2017

(54) VIBRATORY DRIVE

(75) Inventors: Nikolaus Renz, Ulm (DE); Tobias Simmendinger, Neu-Ulm (DE)

(73) Assignee: Robert Bosch GmbH, Stuttgart (DE)

( * ) Notice: Subject to any disclaimer, the term of this patent is extended or adjusted under 35 U.S.C. 154(b) by 1466 days.

(21) Appl. No.: 13/576,752

(22) PCT Filed: Dec. 22, 2010

(86) PCT No.: PCT/EP2010/007884
§ 371 (c)(1),
(2), (4) Date: Oct. 16, 2012

(87) PCT Pub. No.: WO2011/095200
PCT Pub. Date: Aug. 11, 2011

(65) Prior Publication Data

US 2013/0025385 A1 Jan. 31, 2013

(30) Foreign Application Priority Data

Feb. 5, 2010 (DE) ..... 10 2010 006 993

(51) Int. Cl.
*B06B 1/00* (2006.01)
*B06B 1/18* (2006.01)
*E01C 19/28* (2006.01)

(52) U.S. Cl.
CPC ..... *B06B 1/186* (2013.01); *E01C 19/286* (2013.01); *Y10T 74/18344* (2015.01)

(58) Field of Classification Search
CPC ..... B06B 1/186; E01C 19/286
USPC ..... 74/87; 60/413, 414, 416; 404/122
See application file for complete search history.

(56) References Cited

U.S. PATENT DOCUMENTS 3,867,073 A 2/1975 Barrett et al.

FOREIGN PATENT DOCUMENTS

| | | | |
|---|---|---|---|
| DE | 40 33 793 | A1 | 4/1992 |
| DE | 195 14 985 | A1 | 10/1996 |
| DE | 10 2006 060 014 | A1 | 6/2007 |
| DE | 10 2006 050 873 | A1 | 4/2008 |

(Continued)

OTHER PUBLICATIONS

International Search Report corresponding to PCT Application No. PCT/EP2010/007884, mailed Feb. 27, 2012 (German and English language document) (7 pages).

*Primary Examiner* — William C Joyce
(74) *Attorney, Agent, or Firm* — Maginot, Moore & Beck LLP

(57) ABSTRACT

A vibratory drive of a vibrating roller includes an unbalanced-mass vibration generator configured to be used in at least one drum of the vibrating roller. The vibrating roller is operated by an external drive device or advancing device such that the unbalanced-mass vibration generator can be rotated relative to the drum in at least one direction. The unbalanced-mass vibration generator is mechanically coupled to a hydraulic motor, which is configured to be supplied with a pressure medium by a hydraulic pump to rotate the unbalanced-mass vibration generator. At least one high-pressure accumulator is provided to accommodate pressure medium pumped by the hydraulic motor in a pushing operation. The high-pressure accumulator feeds stored pressure medium to the hydraulic motor in a driving operation of the hydraulic motor.

10 Claims, 5 Drawing Sheets

(56) References Cited

FOREIGN PATENT DOCUMENTS

| | | | |
|---|---|---|---|
| DE | 10 2005 060 994 | * | 4/2009 |
| DE | 10 2008 057 897 A1 | | 5/2009 |

* cited by examiner

VIBRATORY DRIVE

This application is a 35 U.S.C. §371 National Stage Application of PCT/EP2010/007884, filed on Dec. 22, 2010, which claims the benefit of priority to Serial No. DE 10 2010 006 993.0, filed on Feb. 5, 2010 in Germany, the disclosures of which are incorporated herein by reference in their entirety.

BACKGROUND

The present disclosure relates to a vibratory drive of a vibrating roller.

A vibrating roller is generally a construction machine and is included in the group of compaction devices in this context. With the aid of such devices it is possible to compact cohesive and noncohesive soils, base layers, anti-frost layers and asphalt. The vibrating roller generally has two roller bodies with preferably smooth drums in the interior of which a vibration unit for improving the compaction result is installed. This provides the vibrating roller with the capability of applying, in addition to its own weight, additional energy into the underlying surface.

A vibrating roller of this generic type is known from the prior art, for example according to DE 40 33 793 C2. This vibrating roller has a roller frame to which a propulsion unit is attached, and at least one drum in the interior of which an unbalance vibrator, which can make it vibrate, is arranged. The unbalance vibrator is composed of an unbalance shaft which is made to rotate by a further drive motor which is disconnected from the propulsion motor. Both the propulsion motor and the further vibrator drive motor are each embodied as hydraulic motors which are fluidically connected via a hydraulic system to a hydraulic pump which is driven by an internal combustion engine. There are also vibrating rollers in which the propulsion motor is supplied with pressure medium by at least one first hydraulic pump, and the vibrator drive motor is supplied with pressure medium by at least one further hydraulic pump.

Furthermore, hydraulic drives with recovery of braking energy in an open or closed hydraulic circuit design are known from the prior art, for example according to DE 10 2006 050 873 A or according to DE 10 2006 060 014 A1. Hydraulic drives of this type have at least one hydraulic pump which is fluidically connected to a hydraulic motor via working lines. The downstream connection of the hydraulic motor can be optionally connected to a high pressure accumulator here.

In the case of a driving mode, the hydraulic pump delivers pressure medium to the hydraulic motor, which accordingly outputs a torque to an output shaft in order to drive a machine and/or a vehicle. In the case of an overrun mode, i.e. in the case in which a torque is applied from the output shaft to the hydraulic motor, the hydraulic motor then operates as a pump and delivers pressure medium in the direction of its downstream connection. In this particular case, the high pressure accumulator is connected to the downstream connection of the hydraulic motor in order to temporarily store the pressure medium which is delivered by the hydraulic motor (now acting as a hydraulic pump).

As soon as the overrun mode changes over again into the driving mode and therefore the hydraulic motor is intended to output a torque to the output shaft again, the high pressure accumulator is connected to the upstream connection of the hydraulic pump and therefore outputs pressure medium under high pressure to the hydraulic pump. As a result, the energy consumption of the hydraulic pressure pump is reduced. In other known hydraulic drives with energy recovery, the hydraulic accumulator is connected to the upstream connection of the hydraulic motor.

Such regenerative hydrostatic drive systems are used in the prior art to recover energy from vehicles in the overrun mode. However, in vibrating rollers of the present generic type this is not possible in this form since vibrating rollers in practical use essentially do not go into an overrun mode which is relevant in terms of energy.

In view of this situation, the object of the present disclosure is to make available an energy recovery possibility for vibrating rollers of this generic type.

SUMMARY

This object is achieved by means of a vibratory drive of a vibrating roller having the features of the disclosure. Advantageous developments of the disclosure are the subject matter of the dependent claims here.

The basic idea of the disclosure is accordingly not to use the overrun mode, which is irrelevant in terms of energy, of the vibrating roller from the propulsion motor for energy recovery but instead the vibratory drive of the vibrating roller comprising an unbalance vibrator, which is inserted, or can be inserted, in a rotatable fashion in at least one vibrating roller drum which is preferably driven by the propulsion motor. The unbalance vibrator is mechanically coupled, or can be mechanically coupled, here to a hydraulic motor (preferably via an output shaft), which hydraulic motor can in turn be supplied with a pressure medium by a hydraulic pump via working lines. According to the disclosure, in this hydrostatic drive of the unbalance vibrator, i.e. in the vibratory drive, at least one high pressure accumulator is provided which serves to accommodate pressure medium which is delivered by the hydraulic motor in an overrun mode, i.e. in a coasting mode of the unbalance vibrator.

In other words, the disclosure for recovering energy does not specify the propulsion unit but rather the vibratory drive as the drive which is relevant for the recovery of energy. This vibratory drive can operate independently of the propulsion unit even in the stationary state of the vibrating roller. Said vibratory drive can effectively be used to recover energy.

One advantageous refinement of the disclosure provides that the hydraulic pump and the hydraulic motor are arranged in a closed circuit in which, in the overrun mode (coasting mode of the unbalance vibrator) the downstream connection of the hydraulic motor can be fluidically connected to the high pressure accumulator, and in the acceleration mode (starting up of the unbalance vibrator) the upstream connection of the hydraulic motor can be fluidically connected to the high pressure accumulator.

As an alternative to this, another advantageous refinement of the disclosure provides that the hydraulic pump and the hydraulic motor are arranged in an open circuit in which the downstream connection of the hydraulic motor can be fluidically connected to a tank or to the high pressure accumulator.

In the case of the open hydraulic circuit design, a valve arrangement is provided by means of which the high pressure accumulator can be optionally fluidically connected to the downstream connection of the hydraulic motor or to the upstream connection of the hydraulic motor. In the case of the closed hydraulic circuit design, a low pressure accumulator is preferably provided which, in the overrun mode of the hydraulic motor can be connected to the upstream connection thereof, and in the driving mode of the hydraulic motor can be connected to the downstream connection thereof.

In this context, the connection between the downstream connection of the hydraulic motor and the upstream connection of the hydraulic motor is preferably continuously maintained.

BRIEF DESCRIPTION OF THE DRAWINGS

The disclosure will be explained in more detail below by means of two exemplary embodiments and with reference to the accompanying figures, of which.

DETAILED DESCRIPTION

Figure 1:
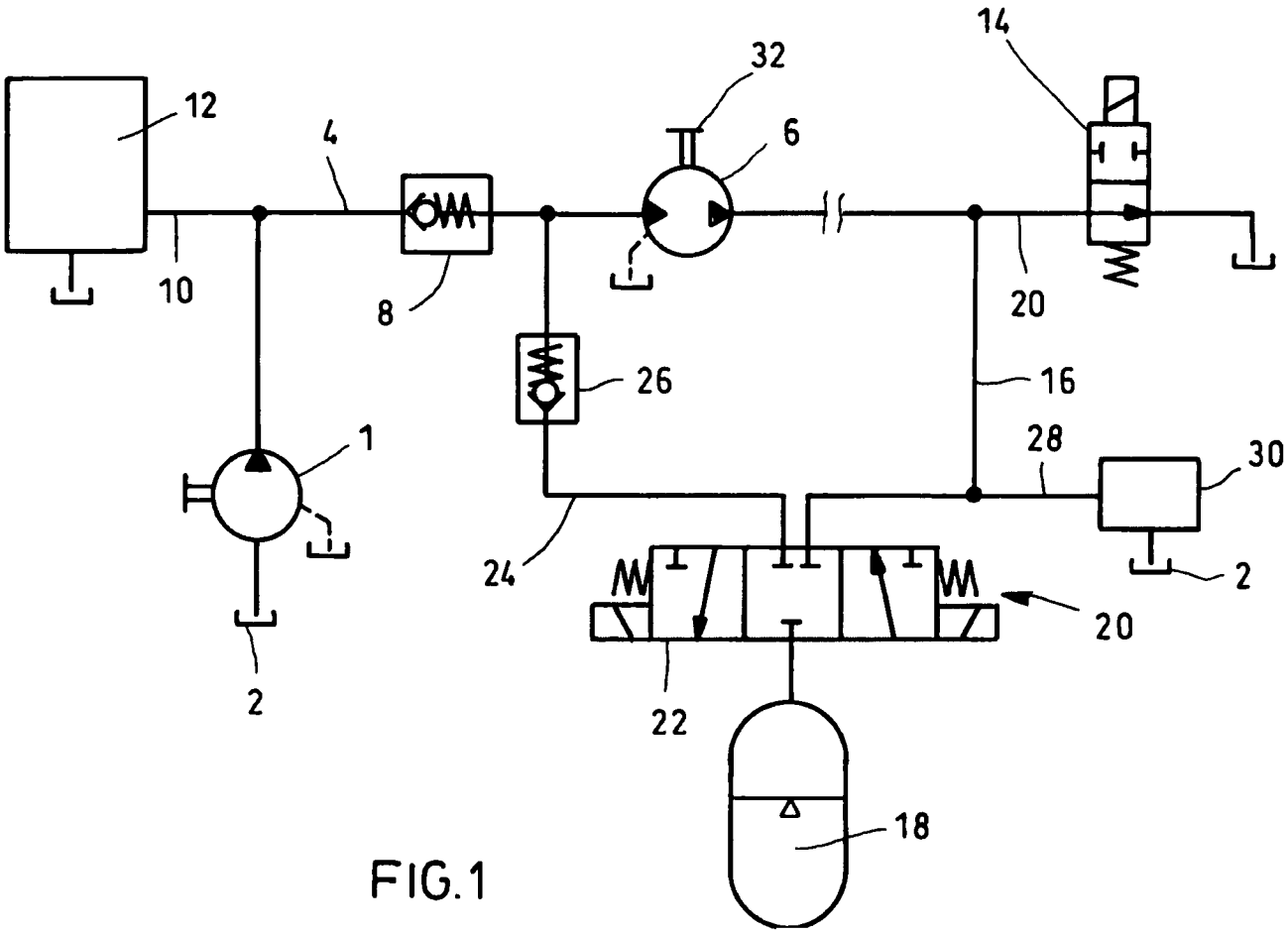
FIG. 1 shows in this context a hydrostatic vibratory drive of a vibrating roller with energy recovery according to a first preferred exemplary embodiment of the disclosure in a first open hydraulic circuit variant.

According to FIG. 1, the vibratory drive has a hydraulic pump 1 whose intake connection is fluidically connected to a pressure medium tank 2, and whose pressure connection is fluidically connected to an upstream connection of a hydraulic motor 6 via a working line 4. In this context a spring-biased nonreturn valve 8, which is set here to a working pressure of approximately 2 bar, is connected into the working line 4. Furthermore, a branch line 10 branches off from the working line 4 to the pressure medium tank 2, into which branch line 10 a pressure-limiting valve which can be adjusted in proportion to the electricity is connected. Said pressure-limiting valve can be adjusted, for example, between 8 bar and 250 bar.

The downstream connection of the hydraulic motor 6 can be connected to the pressure medium tank 2 via a two-way/two-position switching valve 14 which can be activated electromagnetically. An energy recovery line 16 branches off between the switching valve 14 and the downstream connection of the hydraulic motor 6, which energy recovery line 16 leads to a high pressure accumulator 18 which is biased (biasing pressure of, for example 150 bar). In the present case an energy recovery valve arrangement 20 is connected into this energy recovery line 16. Said energy recovery valve arrangement 20 is composed, according to the present exemplary embodiment, of a three-way/three-position switching valve 22 which can be activated electromagnetically and, in a first switched position which is embodied as a spring-centered center position, blocks off all the connections. In a second switched position, the said switching valve 22 connects the downstream connection of the hydraulic motor 6 to the high pressure accumulator 18. In a third switched position, the switching valve 22 connects the high pressure accumulator 18 to an energy recovery line 24, which is connected to the upstream connection of the hydraulic motor 6 downstream of the nonreturn valve 8. In this feedback line 24, a spring-biased nonreturn valve 26 is also connected, said nonreturn valve 26 being preferably set to 2 bar opening pressure.

Finally, a branch line 28, which leads to the pressure medium tank 2 and into which a pressure-limiting valve (preferably set to 250 bar) is connected, is connected between the downstream connection of the hydraulic pump 1 and the three-way/three-position switching valve 22.

In the case of a driving mode of the hydraulic motor 8, which is connected via an output shaft 32 to an unbalance vibrator 34 (illustrated schematically in FIG. 5) which is preferably arranged in a drum 36 of a vibrating roller, for the time being the three-way/three-position switching valve 22 is in its first switched position (shown according to FIG. 1) in which the high pressure accumulator 18 is disconnected from the open hydraulic circuit. The pressure-limiting valve 12 is set to a higher pressure than usually occurs and serves only as a safety valve. In this case, pressure medium is delivered by the hydraulic pump 1 to the upstream connection of the hydraulic motor 6 via the spring-biased nonreturn valve 8, in order to drive said hydraulic motor 6. From there, the now relaxed pressure medium passes back into the tank 2 via the two-way/two-position switching valve 14, which is in the open position in this situation.

In order to switch off the unbalance vibrator 34, the pressure-limiting valve 12 is set to a very small value, with the result that the pressure upstream of the hydraulic motor 6 drops to, for example, 6 bar. The unbalance vibrator 34 vibrates and rotates as a consequence of its moment of mass inertia. In this case, a torque is transmitted via the output shaft 32 to the hydraulic motor 6 which, in this case, now assumes the function of a pump, that is to say the hydraulic motor 6 now feeds pressure medium out of the working line 4 in the direction of the pressure medium tank 2. At this moment, an electronic controller (not illustrated in more detail) which also transmits the signal for adjusting the pressure-limiting valve 12, switches the two-position/two-way switching valve 14 into the closed position and the three-way/three-position switching valve 22 into the second switched position, in which the downstream connection of the hydraulic motor 6 is connected to the high pressure accumulator 18. In this case, the high pressure accumulator 18 is charged, i.e. the pressure medium which is delivered by the hydraulic motor 6 (now in the function of a pump) is conducted into a high pressure accumulator 18. The residual quantity, which the hydraulic motor does not subtract from the quantity of pressure medium delivered by the hydraulic pump 1 flows to the tank via the pressure-limiting valve 12 when there is a low pressure. What is decisive here is that the output shaft 32 of the hydraulic motor 6 is connected to the unbalance vibrator 34 of the vibrating roller, i.e. the run-on energy of the unbalance vibrator 34 is used to recover energy in the form of hydraulic pressure in the high pressure accumulator 18.

If switching occurs from the overrun mode into a driving mode, i.e. into a mode in which the hydraulic motor 6 outputs a torque to the output shaft 32, the two-way/two-position switching valve 14 is switched to the open position, and the three-way/three-position switching valve 22 is switched to the third switched position in which the connection between the downstream connection of the hydraulic motor 6 and the high pressure accumulator 18 is closed and instead a connection is formed between the high pressure accumulator 18 and the upstream connection of the hydraulic motor 6. In this switched position, the high pressure accumulator 18 therefore outputs pressure medium under pressure to the input side of the hydraulic motor 6, with the result that the latter accelerates the unbalance vibrator 34 independently of the hydraulic pump. In this phase, the hydraulic pump firstly still rotates with low pressure. After a time period in the range of seconds, which can be determined by trials or by calculation, the three-way switching valve is moved back to its first switched position by switching off the one electromagnet and the proportional-pressure-limiting valve 12 is set to a high pressure value. The hydraulic motor is then supplied with pressure medium by the hydraulic pump.

If the rotational speed of the hydraulic motor is detected by a rotational speed sensor, the valves 22 and 12 can also be switched or adjusted as a function of the rotational speed or the change in the rotational speed per time unit.

Figure 2:
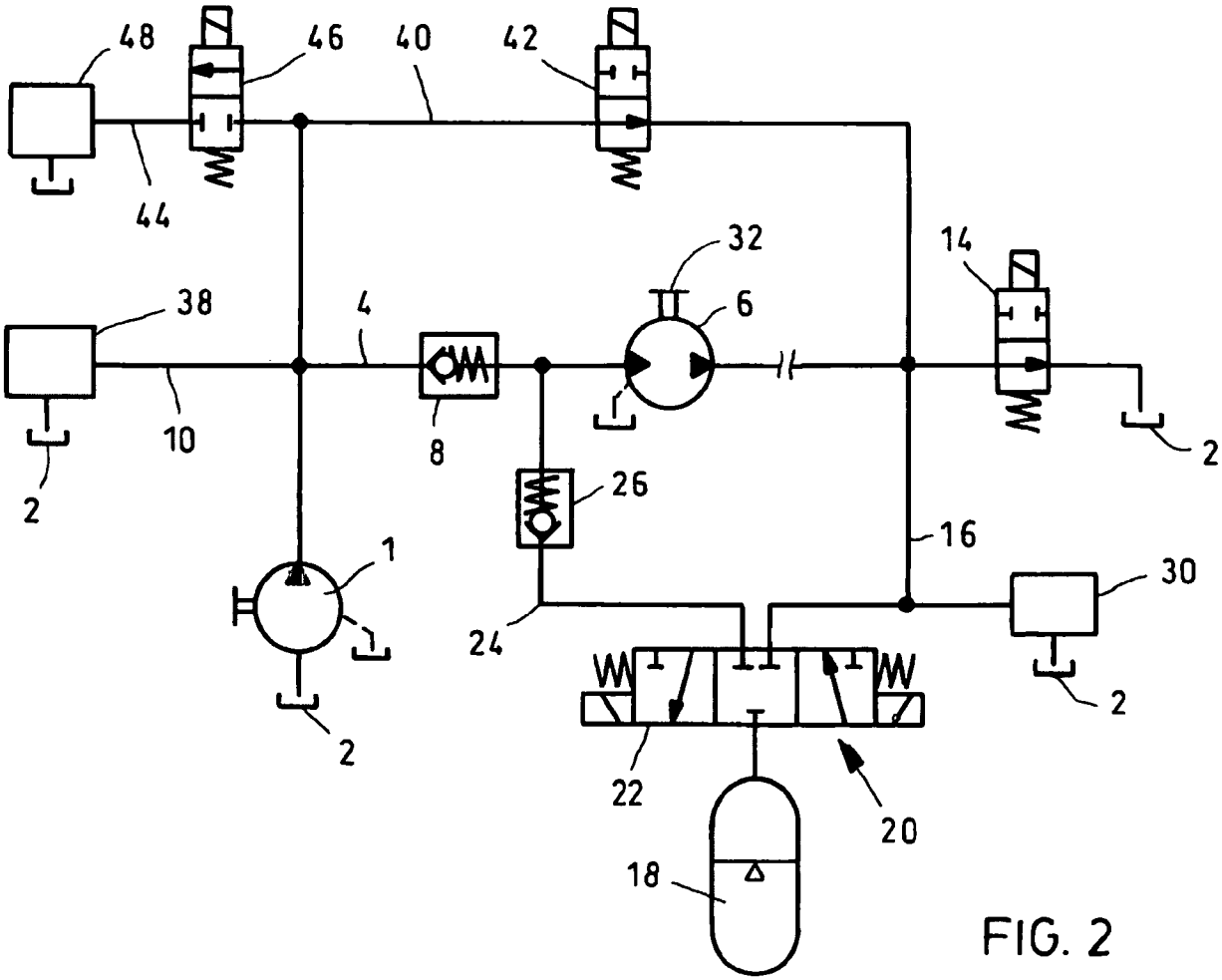
FIG. 2 shows a hydrostatic vibratory drive of a vibrating roller according to the first preferred exemplary embodiment in a second open hydraulic circuit variant.

FIG. 2 shows a second variant of a vibratory drive of a vibrating roller according to an open hydraulic circuit design, wherein details will mainly be given below only on the circuitry differences compared to the first variant described above.

In the first variant above, as already explained a proportional pressure-limiting valve 12 is arranged in a branch line 10 which leads to a pressure medium tank and which branches off from the working line 4 between the hydraulic pump 1 and the hydraulic motor 6. This proportional pressure-limiting valve 12 can be adjusted in a range from 8 to 250 bar. With the latter, the hydraulic motor 6 is also optionally deactivated. That is to say when the vibratory drive is to be switched off, the proportional pressure-limiting valve 12 is set to 8 bar, with the result that the hydraulic pump 6 delivers substantially directly into the pressure medium tank 2. At this moment, the hydraulic motor 6 is switched off as a torque output means.

An alternative embodiment to this is presented by the second variant of the open hydraulic circuit design according to FIG. 2. Accordingly, the proportional pressure-limiting valve 12 specified above is replaced by a first, permanently set pressure-limiting valve 38, which is preferably set to 250 bar, a second permanently set pressure-limiting valve 48, and a direction control valve 46. In addition, a bypass line 40 is provided which bypasses the hydraulic motor 6 and the spring-biased nonreturn valve 8 which is connected upstream of the hydraulic motor 6, i.e. connects the output connection of the hydraulic pump 1 to the output connection of the hydraulic motor 6, and in which a two-position/two-way switching valve 42 is connected. This switching valve 42 is biased into its open position by means of a spring and can be switched electromagnetically into a blocking position. Furthermore, a second branch line 44 branches off from the bypass line 40 upstream of the specified two-position/two-way switching valve 42, which bypass line leads to the pressure medium tank 2. The two-way/two-position switching valve 46 is arranged in this branch line 44, which two-way/two-position switching valve 46 is spring-biased into a blocking position and can be switched electromagnetically into an open position. The pressure-limiting valve 48, which is preferably preset to a value between 10 and 20 bar, is arranged downstream of this further two-way/two-position switching valve 46. The rest of the structure of the hydraulic circuit of the open design according to FIG. 2 corresponds to the hydraulic circuit in the first variant, as has already been described above with reference to FIG. 1, with the result that at this point reference can be made to the corresponding references in the text of the description.

Figure 5:
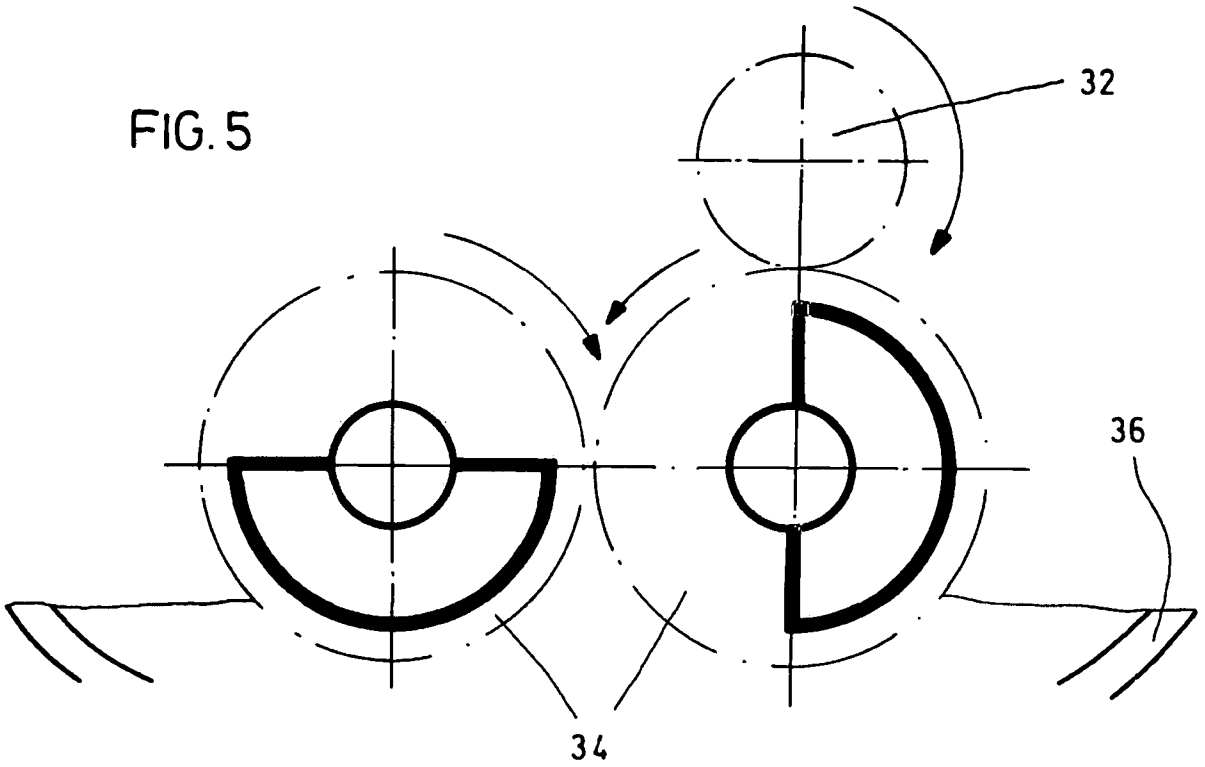
FIG. 5 shows a schematic illustration of a vibrating roller.

In the vibratory drive of the vibrating roller according to FIG. 2, the hydraulic pump 1 also delivers a pressure medium to the upstream connection of the hydraulic motor 6 via the spring-biased nonreturn valve 8 with the result that said hydraulic motor 6 outputs a torque to an output shaft 32 for driving an unbalance vibrator 34 which is illustrated in FIG. 5. The relaxed pressure medium is subsequently conducted away into the pressure medium tank 2 via the two-position/two-way switching valve which is biased into its open position. In this driving phase, the two valves 42 and 46 are in their blocking position.

If the vibratory drive is to be switched off, the two-way/two-position switching valve 46 is switched out of its closed position into the open position. In this case, the hydraulic pump 1 delivers pressure medium into the pressure medium tank 2 via the branch line 44 which branches off from the bypass line 40. The energy recovery from the coasting unbalance vibrator 34, which in this state applies a torque to the hydraulic motor 6 via the output shaft 32, takes place in accordance with the vibratory drive according to FIG. 1, which is described above.

The acceleration also takes place in accordance with the exemplary embodiment according to FIG. 1. For this purpose, the directional control valve 22 is moved into the switched position in which the hydraulic accumulator is connected to the upstream connection of the hydraulic motor 6 via the nonreturn valve 26. After a certain time period or as a function of the rotational speed or as a function of the degree of change in the rotational speed, the directional control valve 22 is moved into its central position, and the directional control valve 46 is moved into its blocking position. Because of the blocking position of the directional control valve 46, the pressure-limiting valve 46 is switched to an inactive setting and a pressure can build up in the working line 4.

The directional control valve 42 is in its opened switched position only if the vibratory drive is to be switched off entirely but the hydraulic pump 1 is still being driven by a primary unit. The hydraulic pump then delivers to the tank with a very low circulation pressure via the valves 42 and 14, with the result that only very low energy losses occur.

At this point it is also to be noted that the drive of the hydraulic motor 6 in the case of the vibratory drive according to FIG. 1 and also according to FIG. 2 has to be configured in such a way that when the hydraulic motor 6 starts the hydraulic pump 1 overcomes the moment of mass inertia of the unbalance vibrator 34. That is to say for the starting of the hydraulic motor 6 at least for a short time an excessively increased power level is demanded of the hydraulic pump drive. In order to provide this power level, the drive of the hydraulic pump 1 must generally be configured in such a way that the starting peak power is applied thereby. In this respect, the hydraulic pump drive is overdimensioned for the normal operating state of the vibratory drive.

As a result of the arrangement of the high pressure accumulator 18, which within the scope of an energy recovery process is charged by the coasting of the unbalance vibrator 34 and the drive of the hydraulic motor 6 which is connected thereto, said high pressure accumulator 18 can, for the purpose of starting the hydraulic motor 6, briefly feed energy into the system and therefore relieve the hydraulic pump 1. As a result, the hydraulic pump drive can be correspondingly reduced in terms of its maximum power.

In the text which follows, a second preferred exemplary embodiment of the disclosure will be described in more detail with reference to two variants in accordance with FIGS. 3 and 4.

Figure 3:
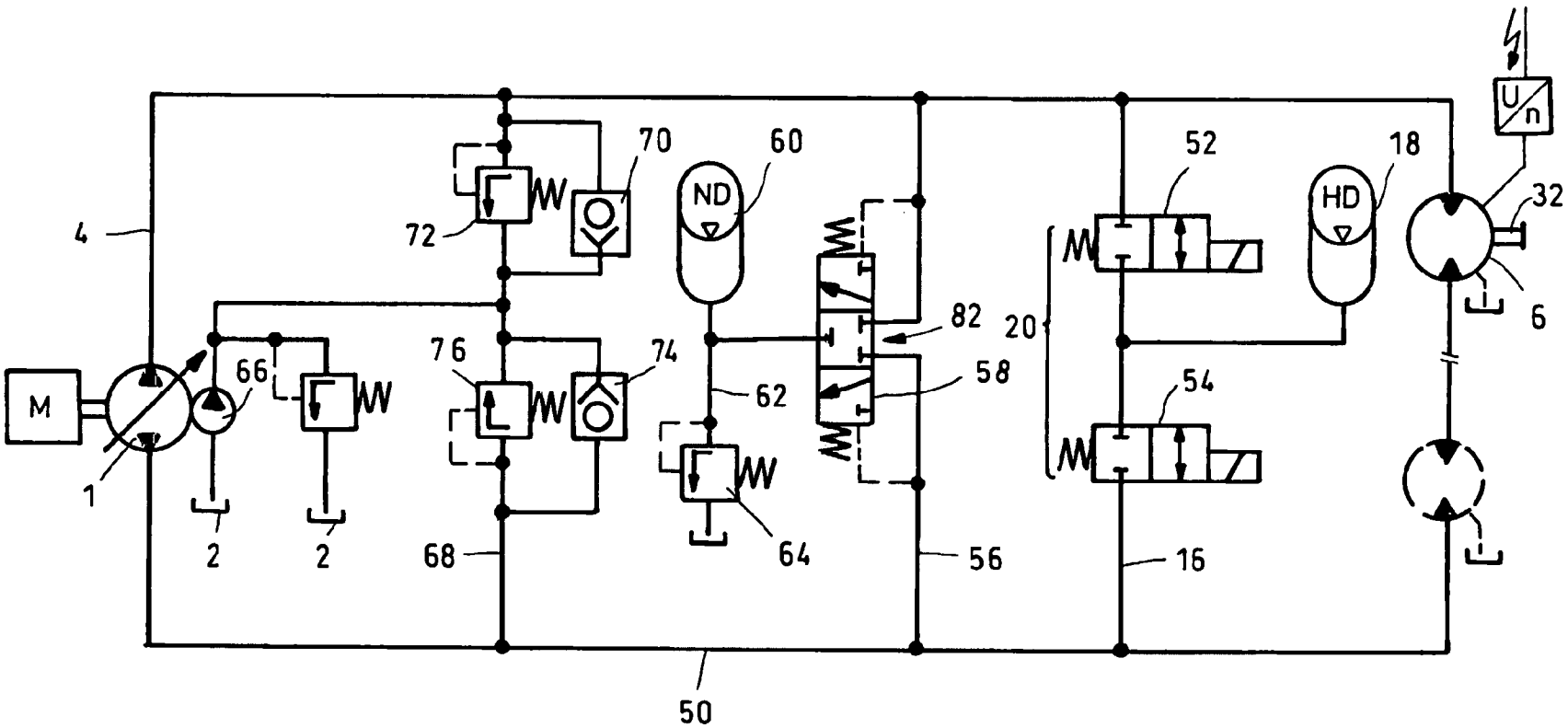
FIG. 3 shows a hydrostatic vibratory drive of a vibrating roller according to a second preferred exemplary embodiment of the disclosure in a first closed hydraulic circuit variant.

FIG. 3 shows a vibratory drive of a vibrating roller in a closed hydraulic circuit design. While the open hydraulic circuit design described with reference to FIGS. 1 and 2 is predominantly provided for more lightweight vibrating rollers, a vibratory drive of the closed hydraulic circuit design is generally provided for heavy vibrating rollers with corresponding heavy unbalance vibrators.

Furthermore, with a hydraulic drive in a closed circuit it is possible to drive the unbalances easily by reversing the delivery direction of a pump, pivotable over zero, in both rotational directions. Different frequencies and amplitudes of the vibration are often implemented by means of the reversal of the direction of rotation.

The vibratory drive according to FIG. 3 has a hydraulic pump 1 which can be adjusted over zero and which is mechanically connected to a drive unit M, for example an internal combustion engine. The hydraulic pump 1 delivers fluid medium via a working line 4 to at least one hydraulic motor 6 which is coupled via an output shaft 32 to an unbalance vibrator 34 (shown in FIG. 5). Further hydraulic motors can optionally be inserted into the working line in a serial fashion with respect to the hydraulic motor mentioned above, as is illustrated, for example, in FIG. 3 by the second hydraulic motor shown there by dashed lines.

At this point it is to be noted that vibrating rollers of the heavy embodiment frequently have two drums into which an unbalance vibrator 34 according to the disclosure is respectively inserted. In this case, at least two hydraulic motors are necessary for the drive of said drums.

An output connection of the at least one hydraulic motor 6 is fluidically connected to an input connection of the hydraulic pump 1 via a feedback line 50. This results in a closed hydraulic circuit. Of course, in the case of a reversed delivery direction of the hydraulic pump 1, the line 50 is the working line, and the line 4 is the feedback line. An energy recovery line 16 is arranged parallel to the at least one hydraulic motor 6, which energy recovery line 16 bypasses the input connection and the output connection of the hydraulic motor 6. A biased high pressure accumulator 18 is connected to the recovery line 16 at a branching point. Furthermore, in the recovery line 16, which actually connects the working line 4 and the feedback line 50 to one another, two 2-way/2-position switching valves 52/54 are inserted in such a way that the connection point of the high pressure accumulator 18 to the recovery line 16 is located between these two switching valves 52, 54. The two switching valves 52, are each spring biased into a blocking switched position and can be switched into an open position electromagnetically independently of one another. A feed line 56, which also starts from the working line 4 and the feedback line 50, is arranged parallel to the recovery line 16. A 3/3-way switching valve 58, to which a low pressure accumulator 60 is connected, is inserted into the feed line 56. The switching valve 58 is embodied here in such a way that it optionally fluidically connects the low pressure accumulator 60 to the working line 4 or to the feedback line 50 in the lateral switched positions, and shuts off the hydraulic accumulator 60 and the lines 4 and 50 from one another in the spring-central position.

In a second switched position of the switching valve 58, the low-pressure accumulator 60 is fluidically connected to the working line 4 via the feed line 56. In a third switched position, the low pressure accumulator 60 is fluidically connected to the feedback line 50 via the feed line 56.

Control lines are connected to two control sides of the switching valve 58, said control lines being fluidically connected to the working line on one side and to the feedback line on the other side. Finally, the low pressure accumulator 60 has a pressure relief line 62, which leads to the pressure medium tank 2 and into which a pressure-limiting valve 64 is connected.

Finally, the vibratory drive according to FIG. 3 is provided with an equalizing pump 66 which is connected to the hydraulic circuit of the closed design in order to equalize oil leakages.

Specifically, the equalizing pump 66 is fluidically connected to the pressure medium tank 2 via an intake duct. The outlet connection of the equalizing pump 66 opens into an equalizing line 68 which fluidically connects the working line 4 and the feedback line 50 parallel to the feed line 56 or the recovery line 16. A nonreturn valve 70 is connected between the junction of the equalizing pump 66 with the equalizing line 68 and the working line 4, which nonreturn valve 70 only permits a flow from the equalizing pump 66 to the working line 4. The pressure-limiting valve 72, which, in the case of an excessively high pressure in the working line 4, opens in the direction of the junction between the equalizing pump 66 and the equalizing line 68, is arranged parallel to the nonreturn valve 70.

A comparable structure can be found in the equalizing line 68 between the junction and the feedback line 50.

That is to say between the junction of the equalizing pump 66 with the equalizing line 68 and of the feedback line 50, a nonreturn valve 74 is also connected, which nonreturn valve 74 only permits a flow in the direction of the feedback line 50. A pressure-limiting valve 76 is arranged parallel to this nonreturn valve 74, which pressure-limiting valve 76 opens in the direction of the junction in the event of an excessively high pressure being present in the feedback line 50. A pressure of 25 to 30 bars is maintained in the respective low pressure line 4 or 50 by the equalizing pump 66.

During normal operation, the motor-driven hydraulic pump 1 delivers a working medium via the working line 4 to the upstream connection of the at least one hydraulic motor 6 in order to drive an unbalance vibrator 34 via the output shaft 32 of said hydraulic motor 6. The relaxed pressure medium is subsequently fed back from the downstream connection of the at least one hydraulic motor 6 to the input connection of the hydraulic pump 1 via the feedback line 50. During normal operation, the two switching valves 52, 54 are in their blocked position. Owing to the pressure in the working line 4, the switching valve 58 is in its third switched position and connects the low pressure accumulator 60 to the feedback line 50.

If the at least one hydraulic motor 6 is now to be switched off, the expulsion-variable hydraulic pump 1 is reduced with respect to its delivery capacity (set to zero), with the result that the hydraulic motor 6 no longer outputs any torque to the output shaft 32 any more. As a result of the mass inertia of the at least one unbalance vibrator 34, the latter, however, temporarily (coasting process) outputs a torque to the hydraulic motor 6 via the output shaft 32, as a result of which said hydraulic motor 6 temporarily assumes the function of a pump. That is to say the hydraulic motor 6 now feeds pressure medium into the feedback line 50.

In this case, the switching valve 54 is opened electromagnetically between the high pressure accumulator 18 and the feedback line 50, with the result that the pressure medium which is temporarily delivered by the hydraulic motor 6 is fed into the high pressure accumulator 16. As soon as this run-on or overrun mode of the hydraulic motor 6 is ended, the switching valve 54 between the high pressure accumulator 18 and the feedback line 50 closes. Since pressure medium is consequently removed from the closed hydraulic circuit and buffered in the high pressure accumulator 18 under pressure during the overrun mode, a lack of pressure medium (partial vacuum) arises in the hydraulic circuit and, in particular, in the working line 4. This is equalized by corresponding switching of the three-way/three-position switching valve 58 in the feed line 56, which switching valve 58 is switched, as a result of a pressure difference occurring between the working line 4 and the feedback line 50, to its second switched position in which the low pressure accumulator 60 is fluidically connected to the working line 4. That is to say the pressure medium which is temporarily stored in the high pressure accumulator 18 is equalized in the closed hydraulic circuit by means of the low pressure accumulator 60, but also additionally by means of the equalizing pump 66.

As soon as the normal driving mode of the at least one hydraulic motor 6 is started, the two-way/two-position switching valve 52 between the high pressure accumulator 18 and the working line 4 is opened, as a result of which the pressure medium buffered under pressure in the high pressure accumulator 18 is fed into the working line 4. In this way, the power necessary to start the hydraulic motor 6 and to overcome the mass inertia of the unbalance vibrator 34 is provided by the high pressure accumulator 18. Once the acceleration process from the hydraulic accumulator 18 is terminated, the valve 52 is moved into its blocking position and the hydraulic pump 1 is pivoted out from zero and adjusted to the delivery volume which corresponds to the desired rotational speed of the hydraulic motor. The adjustment can in turn take place here in a time-dependent fashion or as a function of the rotational speed or the change in rotational speed of the hydraulic motor. A corresponding rotational speed sensor is shown in FIG. 4. Accordingly, the hydraulic pump 1 and the drive M thereof are able to be configured only for an average operation and not for the expected peak powers which can occur during the starting of the hydraulic motor 6. The pressure medium which is now additionally fed into the closed hydraulic circuit from the high pressure accumulator 18 leads to a situation in which the three-position/three-way switching valve 58 in the feed line 56 moves into a switched position in which the low pressure accumulator is now fluidically connected to the feedback line 50. That is to say the excess of pressure medium, which comes about as a result of the relaxation of the high pressure accumulator 18 in the closed hydraulic circuit, is tapped via the low pressure accumulator 60 and buffered there.

If a pressure medium leak occurs in the closed hydraulic circuit system, this leads to a situation in which the hydraulic pressure which is built up by the equalizing pump 66 at the respective nonreturn valves 70, 74 brings about opening of the one or other nonreturn valve in the direction of the working line 4 or of the feedback line 50, as a result of which the corresponding leak is equalized.

Figure 4:
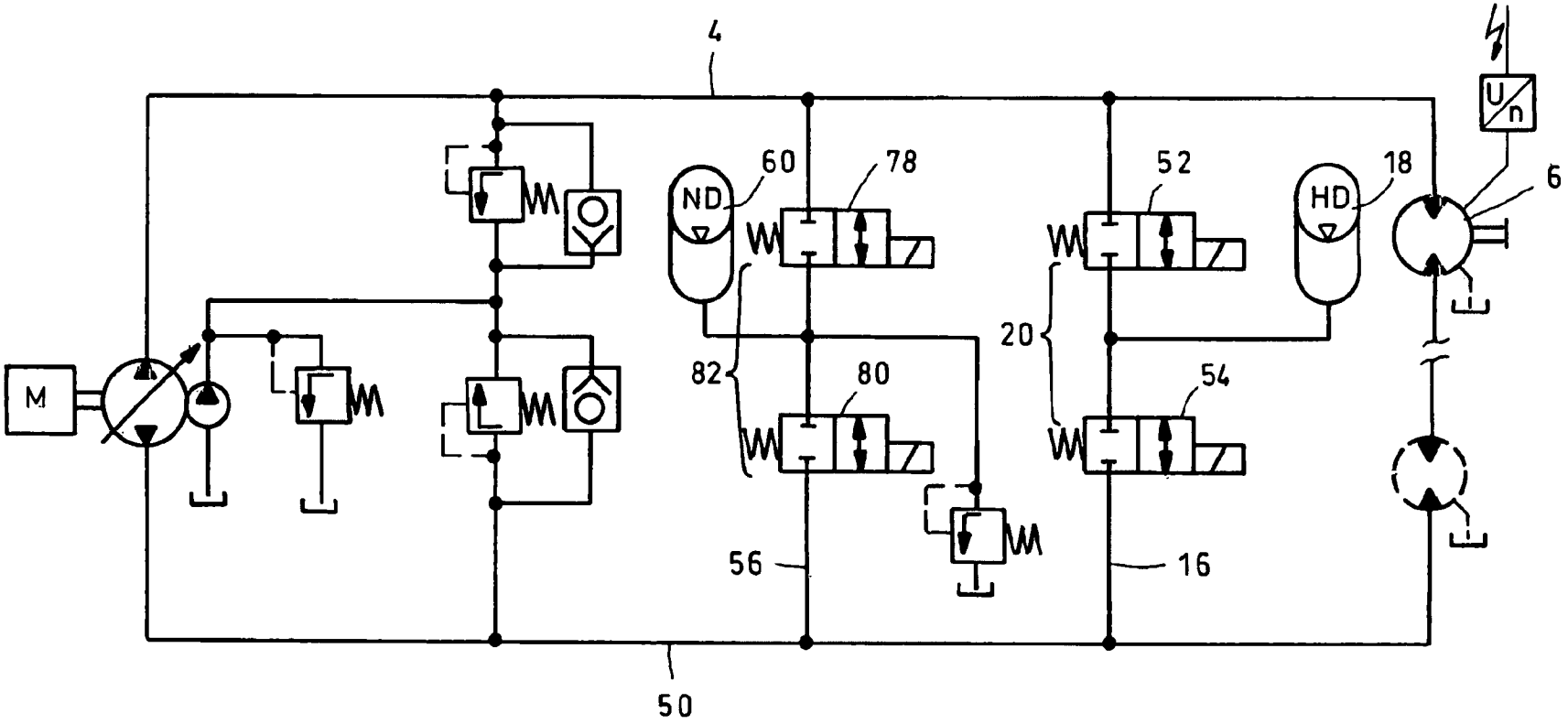
FIG. 4 shows a hydrostatic vibratory drive of a vibrating roller according to the second preferred exemplary embodiment in a second closed hydraulic circuit variant.

FIG. 4 now illustrates a second variant of a hydraulic circuit of the closed design according to the second preferred exemplary embodiment. For reasons of simplification, more details will be given below only on the refinements which are different from the variant according to FIG. 3.

As is apparent from FIG. 4 compared to FIG. 3, the three-way/three-position switching valve 58 which is provided according to FIG. 3 is replaced by two separately electromagnetically switchable two-way/two-position switching valves 78, 80. Specifically, the low-pressure accumulator 60 is fluidically connected to the feed line 56 at a junction point. Between the junction point and the working line 4, the two-way/two-position switching valve 78, which is spring-biased into a blocking position, is connected. Furthermore, the other two-way/two-position switching valve 80 is connected between the junction point and the feedback line 50 and is also spring-biased in the blocking position. The methods of functioning of the two valves 78, 80 correspond here to that method of functioning of the three-way/three-position switching valve 58 according to FIG. 3. That is to say in an overrun mode of the hydraulic motor 6, in which the hydraulic motor 6 feeds pressure medium into the high pressure accumulator 18, the switching valve 78 between the working line 4 and the junction is open with the result that a corresponding quantity of pressure medium can flow out of the low pressure accumulator 60 to the working line 4. In the case of renewed starting of the unbalance vibrator 34, the switching valve 80 between the junction and the feedback line 50 is opened in order to allow the now excess pressure medium whose pressure is consumed to flow back from the downstream connection of the hydraulic motor 6 into the low pressure accumulator 60. All the other functions of the closed hydraulic circuit according to FIG. 4 correspond to those in FIG. 3, with the result that at this point reference can be made to the corresponding references in the text.

The vibratory drive according to the disclosure which has been described by means of the two exemplary embodiments above allows the following advantages to be achieved:

Energy recovery in a vibrating roller is now possible through storage of the rotational energy from the vibratory drive or from the unbalances.

The stored energy can preferably be used to accelerate the rotating masses of the vibratory drive in the case of vibrating rollers, in order to equalize power peaks.

There is no hydraulic connection/coupling between the vibratory drive and the locomotive drive of a vibrating roller.

There is no use of the translatory energy of the vehicle which is irrelevant in terms of energy since vehicles such as the vibrating roller in the working medium without a drive are immediately decelerated automatically.

The storage and release of the energy fed back can also take place in the stationary state of the vehicle.

Implementation of the vibratory drive with energy feedback is possible with simple commercially available valves.

The vibratory drive permits the maximum drive power which is to be installed in an internal combustion engine as a drive unit of the hydraulic pump to be reduced.

Less insertion space is required as a result of a relatively small internal combustion engine.

The consumption of fuel by an internal combustion engine which is made smaller is reduced.

The hydraulic pressure accumulators (high pressure/low pressure accumulator) can be freely arranged or integrated in/on the vehicle frame.

The necessary switching valves and the hydrostatic vibratory drive can be electrically or electronically actuated in the system.

During the acceleration of the unbalance vibrator, the pressure medium supply of the hydraulic motor from the hydraulic accumulator and from the hydraulic pump can preferably occur sequentially.

A vibratory drive of a vibrating roller is disclosed, comprising an unbalance vibrator which can be inserted into at least one drum, operated by an external drive unit or propulsion unit, of the vibrating roller so as to be rotatable relative to said drum in at least one direction. The unbalance vibrator is, according to the disclosure, mechanically coupled to a hydraulic motor which can be supplied with a pressure medium by a hydraulic pump in order to rotate the unbalance vibrator. In addition, at least one high pressure accumulator is provided for accommodating pressure medium which is delivered by the hydraulic motor in an overrun mode. Furthermore, the high pressure accumulator feeds pressure medium stored in a drive mode of the hydraulic motor to the hydraulic motor.

The invention claimed is:

1. A vibratory drive of a vibrating roller, comprising:

an unbalance vibrator inserted in at least one drum of the vibrating roller so as to be relatively rotatable in at least one direction in the at least one drum, the at least one drum being rotatably driven by an external drive unit for propulsion of the vibrating roller;

a hydraulic motor mechanically coupled to the unbalance vibrator;

a hydraulic pump configured to supply a pressure medium to the hydraulic motor in order to rotate the unbalance vibrator; and at least one high pressure accumulator configured to accommodate pressure medium delivered by the hydraulic motor in an overrun mode of the vibratory drive.

2. The vibratory drive as claimed in claim 1, wherein the high pressure accumulator feeds stored pressure medium to the hydraulic motor in a drive mode of the hydraulic motor.

3. The vibratory drive as claimed in claim 2, wherein the hydraulic pump and the hydraulic motor are arranged in a closed circuit in which a downstream connection of the hydraulic motor is fluidically connected to the high pressure accumulator in the overrun mode, and an upstream connection of the hydraulic motor is connected to the high pressure accumulator in the drive mode.

4. The vibratory drive as claimed in claim 3, further comprising a low pressure accumulator which, in the overrun mode of the hydraulic motor, is configured to be connected to the upstream connection of the hydraulic motor between a downstream connection of the hydraulic pump and the upstream connection of the hydraulic motor, and in the drive mode of the hydraulic motor is configured to be connected to the downstream connection of the hydraulic motor.

5. The vibratory drive as claimed in claim 4, further comprising a recovery valve arrangement connected upstream of the high pressure accumulator and configured to optionally fluidically connect the high pressure accumulator to the upstream or downstream connection of the hydraulic motor.

6. The vibratory drive as claimed in claim 5, further comprising a pressure medium-equalizing valve arrangement separate from the recovery valve arrangement and which is connected upstream of the low pressure accumulator, the pressure medium-equalizing valve arrangement configured to optionally fluidically connect the low pressure accumulator to the upstream or downstream connection of the hydraulic motor.

7. The vibratory drive as claimed in claim 6, further comprising a valve controller configured to control the pressure medium-equalizing valve arrangement as a function of the switched position of the recovery valve arrangement.

8. The vibratory drive as claimed in claim 1, wherein the hydraulic pump and the hydraulic motor are arranged in an open circuit in which a downstream connection of the hydraulic motor is configured to be alternatively fluidically connected to a tank or to the high pressure accumulator.

9. The vibratory drive as claimed in claim 8, wherein the high pressure accumulator is configured to be fluidically connected to the tank via a pressure-limiting valve.

10. The vibratory drive as claimed in claim 1, further comprising a valve arrangement via which the high pressure accumulator is configured to be optionally fluidically connected to a downstream connection of the hydraulic motor or to an upstream connection of the hydraulic motor between a downstream connection of the hydraulic pump and the upstream connection of the hydraulic motor.

* * * * *